United States Patent [19]

van der Schoot et al.

[11] Patent Number: 4,730,440

[45] Date of Patent: Mar. 15, 1988

[54] METHOD AND AN APPARATUS FOR PACKAGING EGGS OR SIMILAR VULNERABLE ARTICLES

[75] Inventors: Jelle van der Schoot; Leonardus J. Temming, both of Aalten, Netherlands

[73] Assignee: Staalkat B.V., Aalten, Netherlands

[21] Appl. No.: 7,264

[22] Filed: Jan. 27, 1987

[30] Foreign Application Priority Data

Jan. 30, 1986 [NL] Netherlands ..... 8600225

[51] Int. Cl.[4] ..... B65B 23/06; B65B 35/56; B65B 35/44

[52] U.S. Cl. ..... 53/446; 53/475; 53/497; 53/539; 53/543; 53/544

[58] Field of Search ..... 53/446, 448, 473, 534, 53/537, 497, 539, 543, 544, 142, 475

[56] References Cited

U.S. PATENT DOCUMENTS

| | | | |
|---|---|---|---|
| 2,952,106 | 9/1960 | Rostron | 53/539 X |
| 3,126,993 | 3/1964 | van der Schoot . | |
| 3,169,354 | 2/1965 | Bliss et al. | 53/539 X |
| 3,311,216 | 3/1967 | Jones | 53/497 |
| 3,314,212 | 4/1967 | Peppler | 53/497 X |
| 3,316,688 | 5/1967 | Niederer et al. | 53/497 |
| 3,481,103 | 12/1969 | Summerour | 53/539 X |
| 3,525,195 | 8/1970 | Mosterd | 53/534 |
| 3,722,173 | 3/1973 | Noguchi | 53/539 X |
| 3,874,494 | 4/1975 | Temming . | |
| 3,964,233 | 6/1976 | Thomas | 53/466 |
| 3,973,667 | 8/1976 | Jellema et al. . | |
| 3,974,624 | 8/1976 | Bentley et al. | 53/534 |
| 4,189,898 | 2/1980 | Moulds et al. | 53/446 |
| 4,265,072 | 5/1981 | Egli | 53/544 X |
| 4,575,993 | 3/1986 | Meyn | 53/534 |

FOREIGN PATENT DOCUMENTS 818058 9/1937 France .

*Primary Examiner*—Horace M. Culver

*Attorney, Agent, or Firm*—Murray and Whisenhunt

[57] ABSTRACT

A method and apparatus for packaging eggs supplied by a feed conveyor, said eggs being supplied from said feed conveyor via transfer means to a carton. For the purpose of simultaneously packaging more than one row of eggs, the successive rows of eggs are transferred from said feed conveyor by means of a star wheel and at least one reciprocating sliding plate arranged downstream of said wheel, to two or more successive rows of egg holding or carrying means.

12 Claims, 2 Drawing Figures

METHOD AND AN APPARATUS FOR PACKAGING EGGS OR SIMILAR VULNERABLE ARTICLES

The present invention relates to a method of packaging eggs or similar vulnerable articles supplied by a conveyor belt or the like, in rows extending transverse to a direction of advance, the eggs being transferred from said belt via transfer means to a container.

A similar method is known e.g. from Applicants' U.S. Pat. No. 3,973,667. In this known method, the eggs are supplied by means of the conveyor belt with their longitudinal axes substantially horizontal and transverse to the direction of transport, and, via orienting means comprising relatively movable plates, are oriented so that their longitudinal axes extend substantially in the vertical position, and are thus supplied to a downstream tray or like container by means of an intermediate station arranged underneath the orienting plates.

It is an object of the present invention to improve the method so that a considerably increased packaging capacity is obtained.

To this effect, said method is characterized in that, for the purpose of simultaneously packaging more than one row of eggs, the successive rows of eggs are transferred from the feed conveyor belt by means of a star wheel or the like and at least one reciprocating sliding plate arranged downstream of said wheel to two or more successive rows of egg holding or carrying means at a time. Thus, at least two rows of eggs are supplied simultaneously to e.g. the cavities or depressions of an egg carrying tray arranged downstream of the star wheel. In this manner, the packaging capacity can practically be doubled, which is highly important for present-day machines for candling, weighing and packaging eggs, whose handling capacity is more than 60,000 mostly 100,000 eggs per hour.

In one embodiment of the method according to the invention, an intermediate station is arranged downstream of the star wheel, which station can receive the eggs in two successive rows of egg holders and the eggs are transferred from said double-row station to a package or tray substantially simultaneously, so that a uniform filling of the package or tray is achieved.

The sliding plate used in the method according to the present invention may be channel-shaped, adapted to perform a reciprocating movement, while the subjacent egg holding or carrying means may also be arranged to reciprocate.

When downstream of the star wheel and upstream of the intermediate station there is arranged an orienting mechanism consisting of at least three relatively movable plates, the outer plates can be movable, whereas the central plate is stationary.

Furthermore, the movement of the sliding plate may be coupled to the movement of the movable plates of the orienting means, so that the orienting mechanism is filled without a pause in one smooth movement.

The present invention further relates to apparatus for performing the above described method, comprising a feed conveyor and transfer means downstream of said feed conveyor, as described in Applicants' U.S. Pat. No. 3,874,494 or the corresponding Dutch patent application No. 70.01859. Such an apparatus according to the present invention is characterized in that the transfer means include a star wheel or the like, a reciprocating sliding plate situated downstream of said star wheel for supplying rows of eggs alternately to two or more successive rows of containers or carriers, or e.g. a tray.

When an intermediate station is arranged downstream of the star wheel, said station may be formed with two rows.

Downstream of the star wheel and upstream of the intermediate station may be arranged an orienting mechanism consisting e.g. of three relatively movable plates, only the outer ones of which are movable.

One embodiment of the packaging apparatus according to the present invention will now be described, by way of example, with reference to the accompanying drawing, in which.

Figure 1:
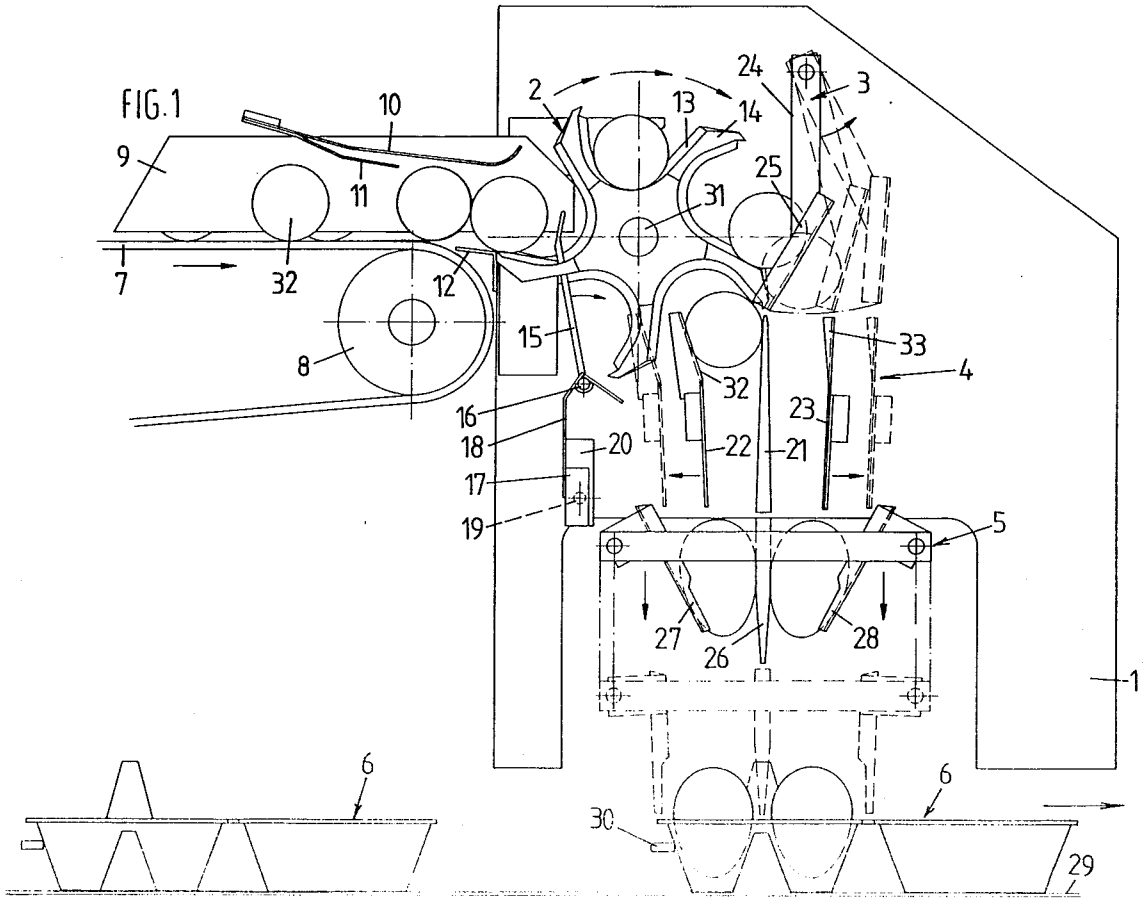
FIG. 1 is a diagrammatic side view of an apparatus for packaging eggs.
Figure 2:
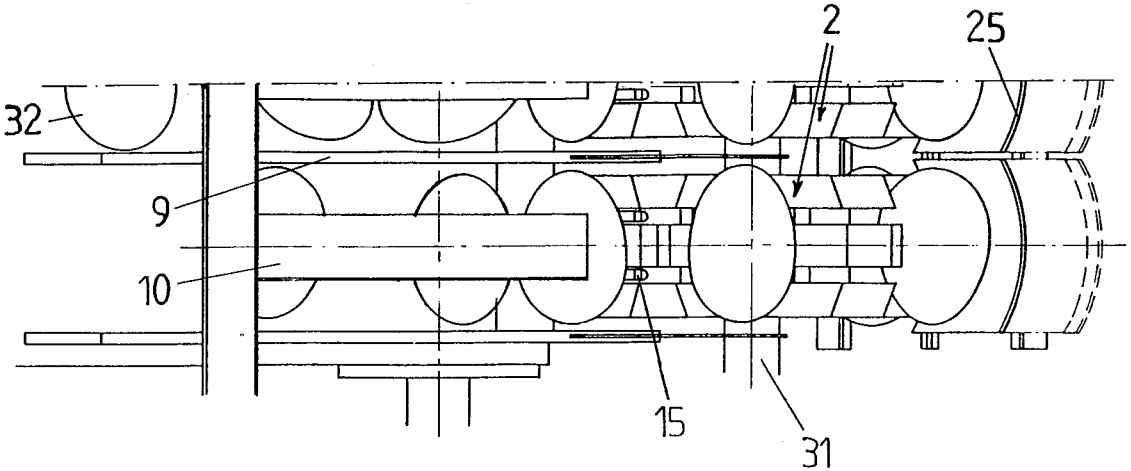
FIG. 2 is a top view of a part of the apparatus of FIG. 1.

As shown in the drawings, a packaging apparatus comprises a frame 1 wherein are mounted a star wheel 2 drivable through a shaft 31 in a manner not shown, an adjacently disposed sliding plate 3 reciprocating in a manner not shown either, a subjacent orienting device 4, an intermediate station 5 disposed subjacent thereto, and a tray 6 disposed subjacent to said station.

Provided upstream of the star wheel 2 is a feed conveyor 7 guided over a return roller 8. Provided over the depicted end of feed conveyor 7 are a plurality of vertical partitions 9 for forming a plurality of channels. At the tops of each of said channels are arranged reciprocating spring members 10, 11 serving as feed regulators. Said members are extensively described in Applicants' U.S. Pat. No. 3,874,494, which is incorporated herein by reference.

The eggs supplied by feed conveyor 7, generally indicated at 32, move from the feed conveyor via a bridging plate 12 fixedly connected to the frame into one of the cavities 13 of star wheel 2. As shown, star wheel 2 mounted on shaft 31 has five of such cavities 13. The teeth 14 forming the cavities 13 are provided with one or more sawtooth-shaped slots for receiving a switch arm 15 rotatably secured to a shaft 16 mounted in the frame. Further secured to switch arm 15 is an arm 18 having a vane 17. In the embodiment shown, vane 17 interrups a light beam 19 before this can shine on a photocell disposed behind vane 17.

After an egg has been supplied to each of the single-row, tandem-disposed cavities 13 of the star wheel, located in a single row one behind the other, all associated vanes 17 will have disappeared from the path of light beam 19, so that photocell 20 is exposed to beam 29. As a result, star wheel 2 will execute a rotation by means, not shown, through an angle of, in the present case, 360:5=72°.

As further shown in the drawings, an orienting device 4 is arranged downstream of star wheel 2. In the present case, said orienting device comprises three plates: a stationary central plate 21, which, together with the movable plates 22, 23 disposed on either side thereof, forms two orienting troughs. In the drawings, plates 22, 23 are also shown in their outermost position, in dash lines. As to the manner of movement of plates 22, 23, reference is made to Applicannts' prior, U.S. Pat. No. 3,126,993, which is incorporated herein by reference, or Dutch patent Nos. 98,338 or 100,062.

As viewed in downstream direction, said sliding plates are arranged between star wheel 2 and orienting plates 21, 22 and 23. Sliding plates 3, which are shown in dash lines in various positions, each consist essentially of an arm 24 at the bottom end of which there is provided the sliding plate or channel 25 proper. As clearly shown in FIG. 1, the first egg of the eggs supplied successively in downstream direction, upon rotation of the star wheel, will be deposited in the space between orienting plates 21 and 22 under the influence of the sliding plate 25 drawn in solid lines, while the following egg will be deposited between orienting plates 21 and 23 by means of the positions of the sliding plate 25 shown in dotted lines. The movement of sliding plate 25 may be coupled to the movement of the orienting plates 22, 23, so that a smooth movement of the eggs is obtained.

After orientation of the eggs, they fall into intermediate station 5. A similar intermediate station, but formed with a single row, is described for example in U.S. Pat. No. 3,224,579 and in U.S. Pat. No. 3,973,667, corresponding with Dutch patent No. 141,526 all in the name of Applicants. Said intermediate station, in the same manner as the orienting station, is provided with a stationary central plate 26 and movable sliding plates 27, 28 arranged on either side thereof.

Arranged underneath intermediate station 5, in the embodiment shown, is a tray 6. Tray 6 is disposed on a transporting conveyor 29 having draggers 30. In the embodiment shown, two trays 6 are shown on transporting conveyor 29.

It will be clear that numerous alterations are possible without departing from the scope of the present invention. For instance, use can be made of a feed conveyor differing from that described hereinbefore. Also the star wheel may have a different construction, well as various members described hereinbefore.

What we claim is:

1. A method for packaging successive rows of eggs or like vulnerable articles in a single package comprising:

(1) supplying the eggs to a conveyor therefor such that successive rows of the eggs extend transversely to the direction of movement of the eggs while being conveyed;

(2) transferring successive rows of the eggs successively from the conveyor into successive rows of cavities extending transversely to the direction of movement of the eggs;

(3) rotating the successive rows of cavities about a central axis after each successive row of cavities is filled with a row of eggs;

(4) continuing the rotation of the rows of cavities with the rows of eggs therein until a row of cavities with a row of eggs therein comes into juxtaposition with a reciprocable plate means;

(5) reciprocating the said plate means while continuing to rotate the rows of cavities with the said rows of eggs therein such that the plate means discharges the row of eggs from one row of cavities as a single row in a package therefor and discharges successive rows of eggs from successive rows of cavities as successive rows of eggs in the said package.

2. A method according to claim 1, wherein the eggs are discharged from the said rotating rows of cavities into an intermediate station having two rows of holders, and each holder receives a single row of eggs from a single row of cavities, and approximately simultaneously discharging the eggs from one holder as a first row in the package therefor and from the other holder as a second row in the package therefor.

3. A method according to claims 1 or 2, wherein downstream of the rotating rows of cavities the eggs are oriented so that the longitudinal axis of the eggs is substantially parallel to the movement of the eggs when contacting the package.

4. An apparatus for packaging successive rows of eggs or like vulnerable articles in a single package comprising:

(1) conveyor means for conveying the eggs along a path;

(2) means for supplying the eggs to a conveyor means such that successive rows of the eggs extend transversely to the moveable direction of the conveyor means along the said path;

(3) transfer means for transferring said successive rows of the eggs successively from the conveyor means;

(4) rotatable cavity means having successive rows of cavities for receiving successive rows of eggs and being rotatable about a central axis;

(5) a reciprocable plate means capable of being reciprocated into juxtaposition to the cavities of the rotatable cavity means;

(6) means for rotating the rotatable cavity means and means for reciprocating the reciprocatable plate means such that while the rotatable cavity means is being rotated the reciprocable plate means discharges the eggs from one row of cavities as a single row of eggs in a package therefor and discharges successive rows of eggs from successive rows of cavities as successive rows of eggs in the said package.

5. An apparatus according to claim 4, wherein downstream of the successive rows of cavities an intermediate station is disposed, said station having holder means for receiving the eggs in two successive rows and from which the two rows of eggs are approximately simultaneously transferred from said intermediate station to said package.

6. An apparatus according to claim 4, wherein the reciprocatable plate is channel-shaped.

7. An apparatus according to claim 4, wherein downstream of the rotatable cavity means and upstream of the intermediate station is disposed a means for orienting said eggs and said means comprises at least two outer relatively moveable plates and one inner nonmoveable plate.

8. An apparatus according to claim 7, wherein the movement of the reciprocating plate means is coupled to the movement of the moveable plates of the orienting means.

9. An apparatus according to claim 4, wherein the said rotatable cavity menas comprise a star wheel and the reciprocable plate is disposed downstream of said star wheel.

10. An apparatus according to claim 9, wherein an intermediate station is disposed downstream of the star wheel, and that said station is formed with two rows.

11. An apparatus according to claim 10, wherein an orienting mens is disposed downstream of said star wheel and upstream of said intermediate station for orienting the eggs.

12. An apparatus according to claim 11, wherein the orienting means includes at least three plates, with only the outer two plates thereof begin moveable.

* * * * *